US009382688B2

(12) United States Patent
Buckner

(10) Patent No.: US 9,382,688 B2
(45) Date of Patent: Jul. 5, 2016

(54) SYSTEM AND METHOD TO EXCAVATE USING PNEUMATIC SHOCK WAVE

(71) Applicant: Don M. Buckner, Okahumpka, FL (US)

(72) Inventor: Don M. Buckner, Okahumpka, FL (US)

(73) Assignee: VAC-TRON EQUIPMENT, LLC, Okahumpka, FL (US)

( * ) Notice: Subject to any disclaimer, the term of this patent is extended or adjusted under 35 U.S.C. 154(b) by 135 days.

(21) Appl. No.: 14/035,337

(22) Filed: Sep. 24, 2013

(65) Prior Publication Data

US 2014/0020268 A1 Jan. 23, 2014

Related U.S. Application Data

(63) Continuation-in-part of application No. 13/533,451, filed on Jun. 26, 2012.

(51) Int. Cl.

| | |
|---|---|
| ***E02F 3/88*** | (2006.01) |
| ***E02F 3/92*** | (2006.01) |
| ***E02F 9/22*** | (2006.01) |

(52) U.S. Cl.

CPC ..... *E02F 3/8891* (2013.01); *E02F 3/8816* (2013.01); *E02F 3/925* (2013.01); *E02F 9/2217* (2013.01)

(58) Field of Classification Search

CPC ..... E02F 3/02; E02F 3/88; E02F 3/8891; E02F 5/145; E02F 3/8816; E02F 3/925

See application file for complete search history.

(56) References Cited

U.S. PATENT DOCUMENTS

| | | | | |
|---|---|---|---|---|
| 494,728 | A | 4/1893 | Bailey | |
| 780,027 | A | 1/1905 | Edwards | |
| 861,745 | A | 7/1907 | Maxwell | |
| 909,543 | A | 1/1909 | Carlesimo | |
| 1,530,654 | A | 3/1925 | Daley | |
| 2,076,823 | A * | 4/1937 | Newell | 37/322 |
| 2,252,803 | A | 8/1941 | Durepaire | |
| 2,413,561 | A | 12/1946 | Hehr | |
| 2,639,601 | A | 5/1953 | Miller | |
| 2,711,598 | A | 6/1955 | Craggs, Jr | |
| 2,956,354 | A | 10/1960 | Varner | |
| 3,263,615 | A | 8/1966 | Hofer | |
| 3,674,100 | A * | 7/1972 | Becker | 175/69 |
| 3,964,792 | A | 6/1976 | Archibald | |
| 4,119,238 | A | 10/1978 | Ja'afar | |
| 4,123,858 | A | 11/1978 | Batchelder | |
| 4,123,860 | A | 11/1978 | De Koning et al. | |
| 4,318,233 | A | 3/1982 | Romain | |
| 4,334,633 | A | 6/1982 | Piegza | |
| 4,418,484 | A | 12/1983 | Wolters et al. | |
| 4,437,244 | A | 3/1984 | Verboom | |
| 4,744,698 | A | 5/1988 | Dallimer | |
| 4,760,656 | A * | 8/1988 | East | 37/323 |

(Continued)

*Primary Examiner* — Jamie L McGowan

(74) *Attorney, Agent, or Firm* — Matthew G. McKinney, Esq.; Allen, Dyer, Doppelt, Milbrath & Gilchrist, P.A.

(57) ABSTRACT

A system and method to excavate using a pneumatic shock wave includes a supply of pressurized fluid, a suction wand, and an air line in communication with the supply of pressurized fluid. A portion of the air line is integrated within the suction wand. The system also includes a dump valve interposed between the supply of pressurized fluid and the portion of the air line integrated within the suction wand. The dump valve is configured to rapidly discharge a pulse of the pressurized fluid out an open end of the air line to generate a shock wave at a distal end of the suction wand to fracture and dislodge soil so that the suction wand can excavate the soil.

16 Claims, 3 Drawing Sheets

(56) References Cited

U.S. PATENT DOCUMENTS

| | | | | | |
|---|---|---|---|---|---|
| 4,776,731 | A | * | 10/1988 | Briggs et al. | 406/153 |
| 4,936,031 | A | * | 6/1990 | Briggs et al. | 37/347 |
| 4,991,321 | A | * | 2/1991 | Artzberger | 37/309 |
| 5,092,963 | A | | 3/1992 | Barker | |
| 5,129,167 | A | * | 7/1992 | Nakahara | 37/318 |
| 5,140,759 | A | * | 8/1992 | Artzberger | 37/347 |
| 5,191,993 | A | | 3/1993 | Wanger | |
| 5,212,891 | A | * | 5/1993 | Schuermann et al. | 37/323 |
| 5,311,905 | A | * | 5/1994 | De Santis | 137/613 |
| 5,500,976 | A | | 3/1996 | Rohrbacher | |
| 5,515,625 | A | | 5/1996 | Keigley | |
| 5,782,414 | A | * | 7/1998 | Nathenson | 239/589 |
| 5,887,667 | A | * | 3/1999 | Van Zante et al. | 175/67 |
| 5,901,478 | A | * | 5/1999 | Sawyer, Jr. | 37/323 |
| 5,966,847 | A | | 10/1999 | Nathenson et al. | |
| D423,521 | S | | 4/2000 | Walter | |
| 6,167,878 | B1 | | 1/2001 | Nickerson et al. | |
| 6,360,458 | B2 | | 3/2002 | Dolister | |
| 6,397,967 | B1 | | 6/2002 | McIlwraith | |
| 6,484,422 | B1 | * | 11/2002 | Bain et al. | 37/323 |
| 6,499,934 | B1 | | 12/2002 | Kaczmarski | |
| 6,550,406 | B2 | | 4/2003 | Bass | |
| 6,604,304 | B1 | | 8/2003 | Slabach | |
| 6,691,436 | B2 | * | 2/2004 | Chizek, Sr. | 37/322 |
| 6,863,807 | B2 | | 3/2005 | Crawford, III | |
| 6,957,506 | B1 | * | 10/2005 | Fair | 37/323 |
| RE38,872 | E | * | 11/2005 | Hayes | 37/323 |
| 6,988,568 | B2 | | 1/2006 | Buckner | |
| 7,395,618 | B2 | | 7/2008 | Jacobsen et al. | |
| 7,484,322 | B2 | * | 2/2009 | Maybury et al. | 37/323 |
| 7,647,712 | B2 | | 1/2010 | Tack | |
| 7,676,966 | B2 | | 3/2010 | Taplin | |
| 7,743,537 | B2 | * | 6/2010 | Maybury, Jr. | 37/323 |
| 7,837,050 | B2 | | 11/2010 | Maybury, Jr. | |
| 8,011,857 | B2 | * | 9/2011 | Foo et al. | 405/224.1 |
| 8,066,140 | B1 | | 11/2011 | Young | |
| 8,336,231 | B2 | * | 12/2012 | Maybury et al. | 37/323 |
| 8,719,997 | B1 | * | 5/2014 | Nathenson et al. | 15/300.1 |
| 2005/0108848 | A1 | * | 5/2005 | Buckner | 15/321 |
| 2005/0115548 | A1 | | 6/2005 | Wilson | |
| 2005/0268499 | A1 | | 12/2005 | Weinrib et al. | |
| 2008/0085163 | A1 | * | 4/2008 | Maybury | 406/152 |
| 2014/0020268 | A1 | * | 1/2014 | Buckner | 37/304 |

* cited by examiner

FIG. 5
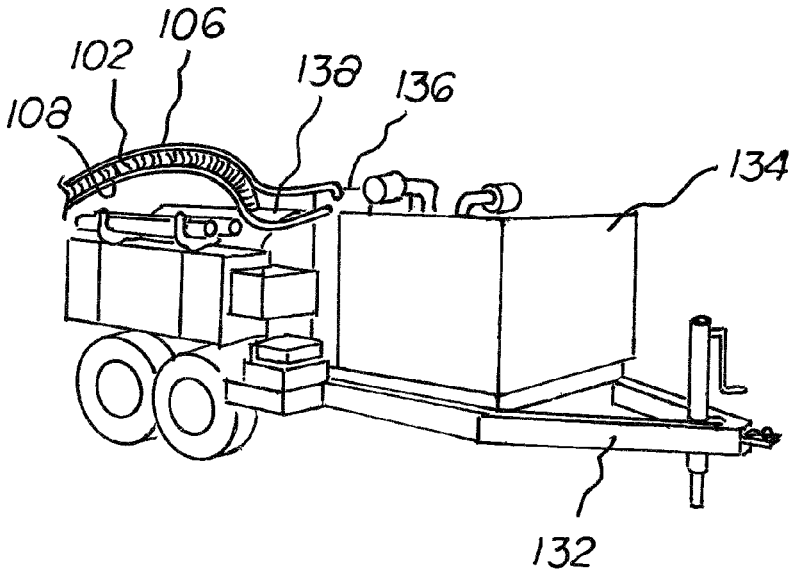
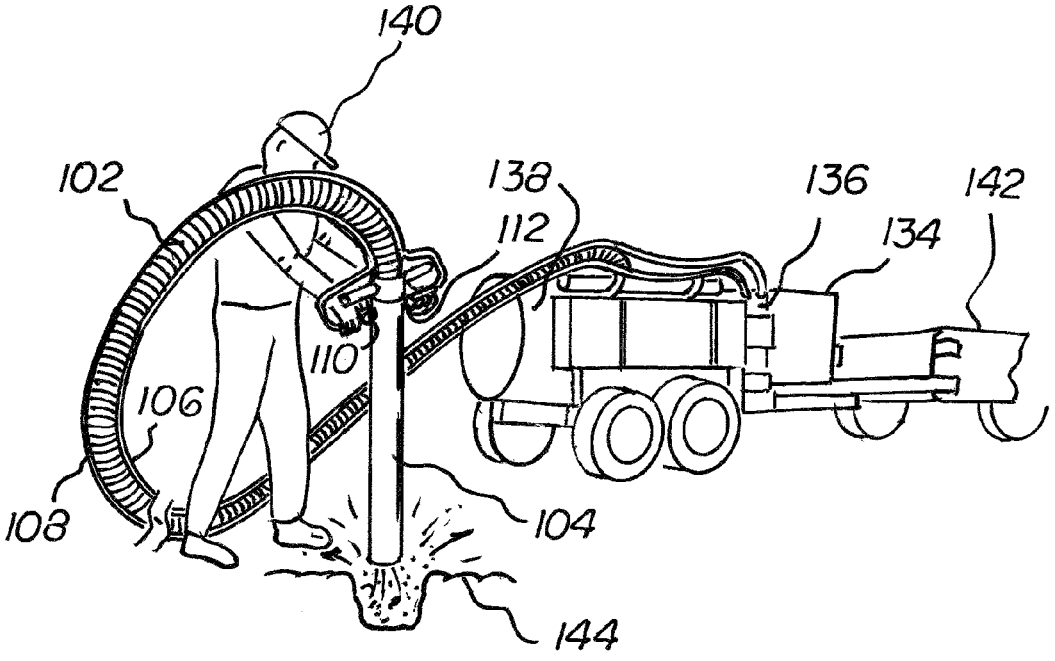
FIG. 6

SYSTEM AND METHOD TO EXCAVATE USING PNEUMATIC SHOCK WAVE

I. CROSS REFERENCE TO RELATED APPLICATIONS

This application is a continuation-in-part of U.S. patent application Ser. No. 13/533,451 filed Jun. 26, 2012.

II. FIELD OF THE INVENTION

The present invention relates generally to a system and method to excavate using a pneumatic shock wave.

III. BACKGROUND

Industrial vacuum equipment has dozens of wet and dry uses such as hydro excavation, air excavation and vacuum excavation. In addition, the equipment can be used for directional drilling slurry removal, industrial clean-up, waste clean-up, lateral and storm drain clean-out, oil spill clean-up and other natural disaster clean-up applications. The vacuum systems may be mounted to a truck or trailer and are typically powered by gas or diesel engines.

Compressed air has also been used for loosening soil from around buried water pipes, gas mains, and electrical cables, and other buried utilities. However, using a steady stream of compressed air at high velocities generates a large amount of dust and debris blowback at the user during excavation. In addition, the compressed air even at high velocities may not provide enough force to quickly fracture and dislodge rocks and cohesive soils. Accordingly, what is needed is a method and system to excavate that is efficient in all subsurface conditions.

IV. SUMMARY

The following presents a simplified summary of one or more embodiments in order to provide a basic understanding of some aspects of such embodiments. This summary is not an extensive overview of the one or more embodiments, and is intended to neither identify key or critical elements of the embodiments nor delineate the scope of such embodiments. Its sole purpose is to present some concepts of the described embodiments in a simplified form as a prelude to the more detailed description that is presented later.

In a particular embodiment, a system to excavate using a pneumatic shock wave is disclosed. The system includes a supply of pressurized fluid, a suction wand, and an air line in communication with the supply of pressurized fluid. A portion of the air line is integrated within the suction wand. The system also includes a dump valve interposed between the supply of pressurized fluid and the portion of the air line integrated within the suction wand. The dump valve is configured to rapidly discharge a pulse of the pressurized fluid out an open end of the air line to generate a shock wave at a distal end of the suction wand to fracture and dislodge soil so that the suction wand can excavate the soil.

In another particular embodiment, a method to excavate using a pneumatic shock wave is disclosed. The method includes providing a supply of pressurized fluid, securing the supply of pressurized fluid to an air line, and generating a shock wave to fracture soil by rapidly discharging a pulse of the pressurized fluid out an open end of the air line. In addition, the method includes excavating the soil using a suction wand. The discharging of the pulse of the pressurized fluid occurs using a dump valve. Pressurizing the supply of pressurized fluid is accomplished using a gas or diesel powered compressor and the pressurized fluid may be air, water, or any combination thereof.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

V. BRIEF DESCRIPTION OF THE DRAWINGS

FIG. 5 is a perspective view of a trailer and associated equipment that may be used with a particular embodiment of the system to excavate using a pneumatic shock wave; and FIG. 6 is a perspective view of a person using the system to excavate using a pneumatic shock wave.

VI. DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

Figure 1:
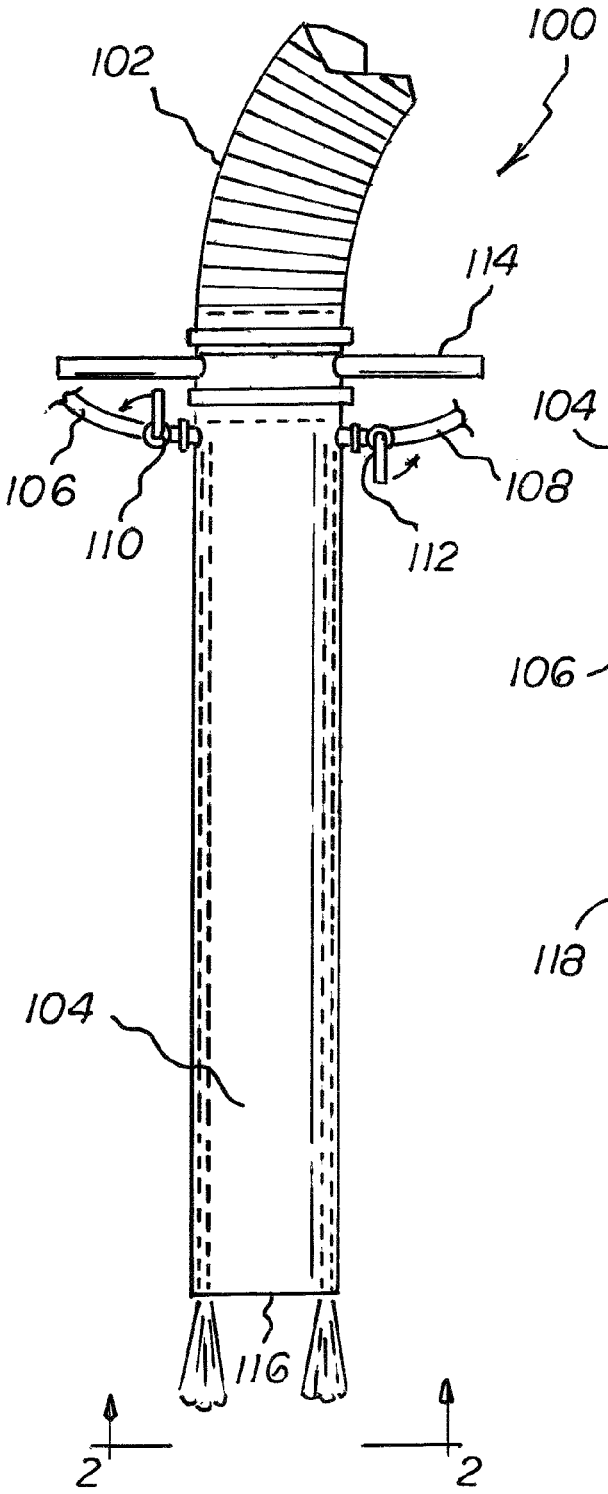
FIG. 1 is an elevation view of a particular embodiment of a system to excavate using a pneumatic shock wave.
Figure 2:
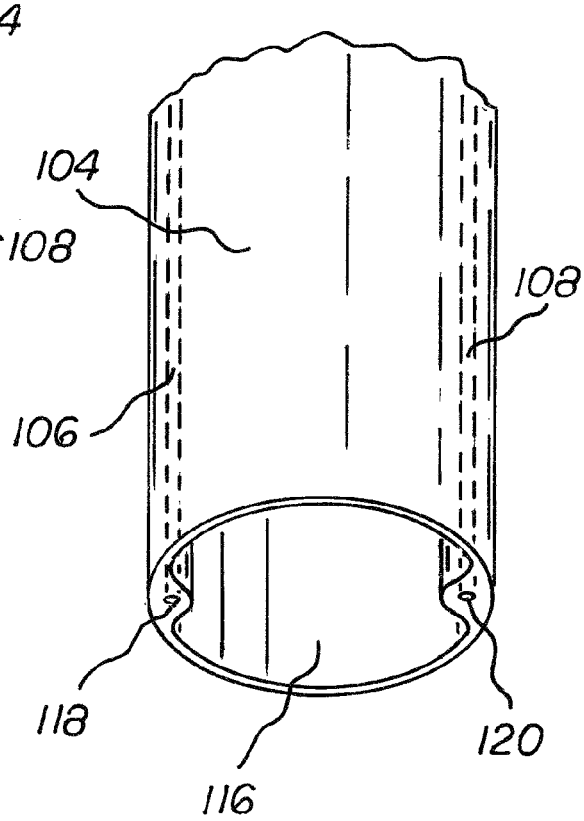
FIG. 2 is a partial perspective view of the system shown in FIG. 1 taken in the direction of lines 2-2.

Referring to FIGS. 1 and 2, a particular illustrative embodiment of a system to excavate using pneumatic shock wave is disclosed. The system 100 includes a suction wand 104 that is used to vacuum debris into a debris tank. The suction wand 104 is secured to a suction hose 102. The suction hose 102 is in communication with a pump that provides suction to the distal end 116 of the suction wand 104 to vacuum soil, water, and other debris that are being excavated from a site. Handle bars 114 extend outwardly from opposing sides of the suction wand 104 so that user can grasp the handle bars 114 to move a distal end 116 of the suction wand 104 over an area. The negative pressure at the distal end 116 of the suction wand 104 causes material to be vacuumed up into the suction wand 104 and through the suction hose 102 to a debris tank.

Often times the ground is comprised of cohesive soils and is required to be broken down into smaller pieces so that the material can be vacuumed up through the suction wand 104. Pressurized fluid such as water or air has been used in the past to assist in breaking down the material. However, pressurized fluid may not have enough velocity to break the material. Accordingly, the system includes means to generate a pneumatic shock wave that discharges at the distal end 116 of the suction wand 104 to fracture and dislodge the ground in the vicinity of the discharge. The suction wand 104 is preferably fabricated of a reinforced rubber or plastic so that it is able to absorb the force of the pneumatic shock wave.

The means to generate the pneumatic shock wave includes a compressor and accumulator in communication with a first air line 106 secured to the suction wand 104. An engine is sized to match the power requirements of the compressor. For example, the engine may supply five to ten horsepower at three to four thousand revolutions per minute. The compressor may supply twenty to thirty cubic feet per minute of air volume to the accumulator. The fluid supply for the pneumatic shock wave comes from the accumulator, which is pressurized to the desired pressure of more than 100 psi to 500 psi.

In a particular embodiment, the first air line 106 is integrated into the interior of the suction wand 104. The first air line 106 is suitable for use with compressed fluid and is typically several feet long with an internal diameter chosen to minimize the pressure drop along its length. For example, the diameter of the first air line 106 may be 1½ inches. A first dump valve 110 separates compressed fluid that is generated by the compressor from the first nozzle 118, which is in communication with the first air line 106. The first dump valve 110 may be activated manually by turning a handle or by triggering an actuating valve. The first dump valve 110 may be a two-way normally closed lever valve with a spring return. Accordingly, when the lever is squeezed or moved, a plunger is depressed and the internal valving is actuated such that a pulse of compressed fluid is rapidly released from the accumulator through the first air line 108 to the first nozzle. After the pulse of compressed fluid is released, the first dump valve 110 is closed and the system is re-pressurized. A pressure gauge may be mounted to the first 110 dump valve to display the available pressure. Thus, when the first dump valve 110 is activated, pressurized fluid is rapidly expelled through the first nozzle 118 at the distal end 116 of the suction wand 104 via the first air line 106 generating a pneumatic shock wave to fracture the soil. In a particular embodiment shown in FIG. 2, the distal end 116 of the suction wand 104 includes the first nozzle 118 and a second nozzle 120 that are integrated into a sidewall of the suction wand 104. A second air line 108 is connected to the second nozzle 120 and the second air line 108 is also in communication with the compressor and accumulator. A second dump valve 112 separates the compressed fluid from the second nozzle 120. The first dump valve 110 and the second dump valve 112 may be operated independently or simultaneously to deliver the desired pneumatic shock wave. In addition, because the first nozzle and second nozzle 118, 120 are integrated inside the suction tube 104, this helps prevent the nozzles 118, 120 from inadvertently snagging any obstacles such as roots and rocks that may be encountered when excavating.

Figure 3:
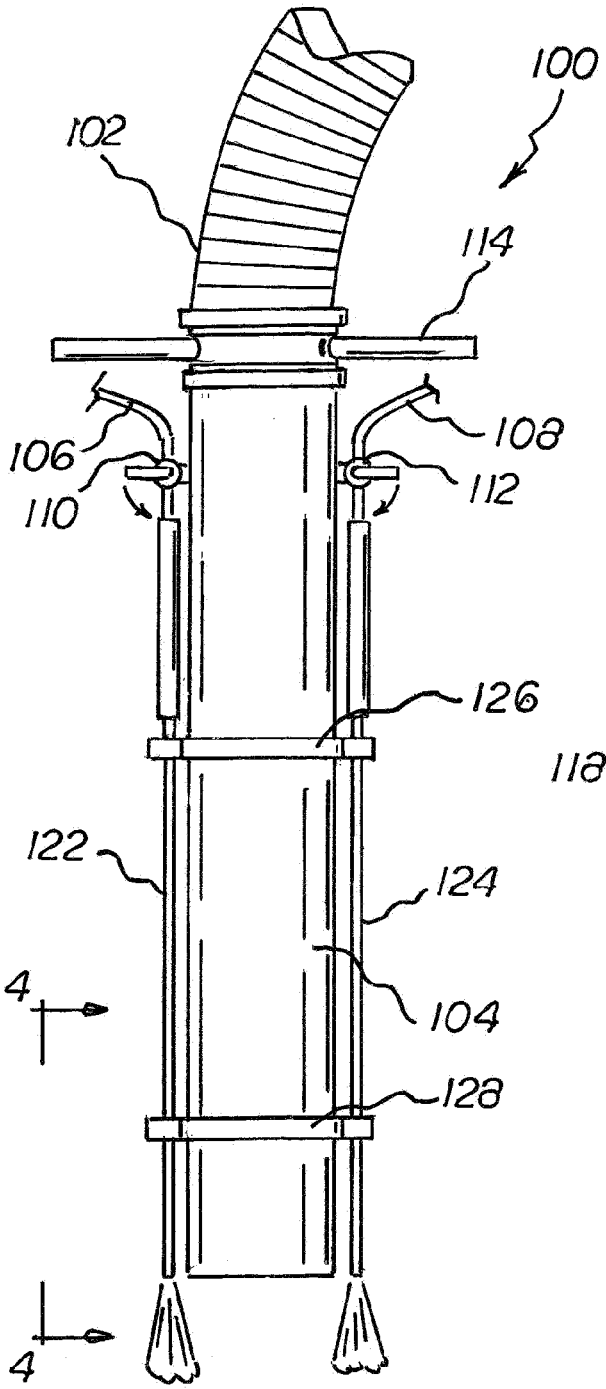
FIG. 3 is an elevational view of the system showing an alternative configuration with air lines secured to an exterior surface of the suction wand.
Figure 4:
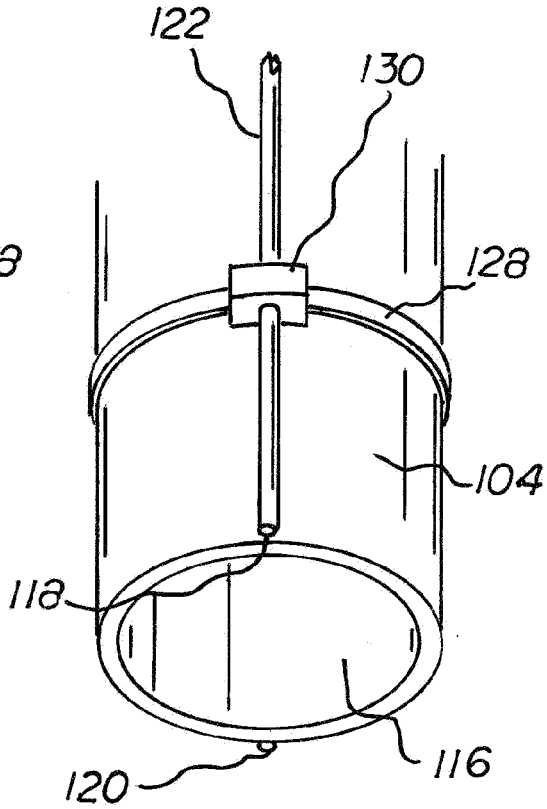
FIG. 4 is a partial perspective view of the system shown in FIG. 3 taken in the direction of lines 3-3.

In a second embodiment shown in FIGS. 3 and 4, the nozzle 206 is secured to the distal end of a first conduit 122, where the first conduit 122 is secured along the exterior of the suction wand 104. The first conduit 122 may be removed from the suction wand 104 so that the user may have additional flexibility to direct the pneumatic shock wave away from the suction wand 104. Similarly, a second conduit 124 may be secured to an opposing exterior surface of the suction wand 104. An upper clamp 126 is used to secure the first and second conduits 122, 124 to the suction wand 104. A lower clamp 128 is disposed proximate the distal end 116 of the suction wand 104 and aligns the first and second conduits substantially parallel to the suction wand. As best shown in FIG. 4, a conduit connector 130 is used to snap the respective conduit 122, 124 in place on the upper and lower clamps 126, 128.

The first and second conduits 122, 124 are connected to the first and second dump valves 110, 112, respectively, to rapidly release the pulse of compressed fluid to generate the pneumatic shock wave. As explained above, the dump valves 110, 112 may be activated manually by squeezing or turning a handle, or by triggering an actuating valve. The axes of the nozzles 116, 118 and suction wand 104 do not intersect when mounted to the suction wand 104.

A trailer 132 similar to that shown in FIGS. 5 and 6 may be used to mount the various vacuum and excavation equipment for transport. This includes the pump 134 for the suction wand 104, the compressor and accumulator 136, and the debris tank 138. The trailer 132 includes wheels and a hitch for connecting the trailer 132 to a vehicle 142 as shown in FIG. 6. An adjustable jack at the front of the trailer 132 is used to stabilize the trailer 132 when disconnected from the vehicle 142. A gasoline or diesel engine may be mounted to the trailer 132 and used to power the vacuum equipment, hydraulic pumps, pneumatic pumps, the compressor or any combination thereof. The suction hose 102 is connected to the debris tank 138.

In operation, the operator 140 grasps the suction wand 104 and applies downward pressure to the ground 144. The operator 140 sweeps the distal end 116 of the suction wand 104 from side to side. The suction hose 102 vacuums the debris for the excavation to the debris tank 138. The operator 140 may discharge a pneumatic shock wave as needed to fracture and dislodge cohesive soil and rocks for excavation. The first and second air lines 106, 108 may be attached along the suction hose 102 or may run independently from the compressor and accumulator 136 to the suction wand 104.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A system to excavate using a pneumatic shock wave, the system comprising:

a supply of compressed air;

a suction wand;

an air line having a first end and an open end, the first end in communication with the supply of compressed air and the air line coupled to the suction wand; and a dump valve interposed between the supply of compressed air and the open end of the air line, wherein the entire portion of the air line between the dump valve and the open end has a constant diameter and the dump valve is configured to rapidly open to discharge a pulse of the compressed air to generate the pneumatic shock wave at the open end of the air line to fracture soil.

2. The system of claim 1, further comprising a suction hose secured to the suction wand to vacuum the soil.

3. The system of claim 2, further comprising a compressor to pressurize the supply of compressed air.

4. The system of claim 3, further comprising an accumulator in communication with the compressor to store the supply of compressed air, wherein the accumulator is in communication with the air line.

5. The system of claim 4, the dump valve further comprising internal valving that is configured to be actuated such that the pulse of compressed air is rapidly released from the accumulator through the unrestricted open end of the air line to generate the shock wave.

6. The system of claim 5, wherein the supply of compressed air is pressurized to at least 100 pounds per square inch.

7. The system of claim 6, further comprising a debris tank in communication with the suction hose.

8. The system of claim 7, further comprising a pressure gauge mounted to the dump valve to display a pressure of the supply of compressed air.

9. The system of claim 8, wherein a diameter of the air line is 1.5 inches.

10. A method to excavate using a pneumatic shock wave, the method comprising:

providing a supply of compressed air;

securing the supply of compressed air to a first end of an air line;

generating the pneumatic shock wave to fracture soil by by rapidly opening a dump valve interposed between the supply of compressed air and an open end of the air line to discharge a pulse of compressed air, wherein the entire portion of the air line between the dump valve and the open end has a constant diameter; and excavating the soil using a suction wand.

11. The method of claim 10, further comprising pressurizing the supply of compressed air using a compressor.

12. The method of claim 11, further comprising storing the supply of compressed air in an accumulator in communication with the air line.

13. The method of claim 12, wherein the dump valve is a two-way normally closed lever valve with a spring return.

14. The method of claim 13, wherein the supply of compressed air is pressurized to at least 100 pounds per square inch.

15. The method of claim 14, further comprising storing the soil in a debris tank that is in communication with the suction wand.

16. The method of claim 15, further comprising mounting a pressure gauge to the dump valve to display a pressure of the supply of compressed air.

* * * * *